US008044921B2

(12) United States Patent
Hong

(10) Patent No.: US 8,044,921 B2
(45) Date of Patent: Oct. 25, 2011

(54) APPARATUS AND METHOD FOR DYNAMICALLY CONTROLLING BACKLIGHT

(75) Inventor: Jion-Iou Hong, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 987 days.

(21) Appl. No.: 11/953,083

(22) Filed: Dec. 10, 2007

(65) Prior Publication Data

US 2009/0091528 A1 Apr. 9, 2009

(30) Foreign Application Priority Data

Oct. 5, 2007 (TW) ..... 96137459 A

(51) Int. Cl.
*G09G 3/36* (2006.01)
*G09G 5/10* (2006.01)
*G09F 13/04* (2006.01)

(52) U.S. Cl. ..... 345/102; 345/690; 362/97.1

(58) Field of Classification Search ..... 345/82–84, 345/87–89, 102, 204, 690, 691; 362/97.1–97.3
See application file for complete search history.

(56) References Cited

U.S. PATENT DOCUMENTS

2004/0001076 A1* 1/2004 Leng et al. ..... 345/690
2006/0001641 A1* 1/2006 Degwekar et al. ..... 345/102
2007/0216636 A1* 9/2007 Lo ..... 345/102
2007/0222740 A1* 9/2007 Hanada ..... 345/102

* cited by examiner

*Primary Examiner* — Bipin Shalwala
*Assistant Examiner* — Keith Crawley
(74) *Attorney, Agent, or Firm* — Jianq Chyun IP Office

(57) ABSTRACT

An apparatus for dynamically controlling backlight source receives a pixel input data, and outputs a pixel output data and a PWM signal. The apparatus includes image analysis unit for receiving the pixel input data and outputting image data after performing image analysis. An information unit stores relation data including luminance adjusting data and PWM adjusting data corresponding to gray level range. A luminance calculation unit receives the image data from the image analysis unit and the relation data from the information unit, and calculates a required gray level corresponding to a required luminance, and outputs a required pixel luminance data and a required PWM data according to the required gray level. A PWM adjusting unit receives the required PWM data and outputs the PWM signal. A multiplication unit receives the pixel input data and performs luminance adjustment according to the required pixel luminance data for outputting the pixel output data.

21 Claims, 3 Drawing Sheets

APPARATUS AND METHOD FOR DYNAMICALLY CONTROLLING BACKLIGHT

CROSS-REFERENCE TO RELATED APPLICATION

This application claims the priority benefit of Taiwan application serial no. 96137459, filed on Oct. 5, 2007. The entirety of the above-mentioned patent application is hereby incorporated by reference herein and made a part of this specification.

BACKGROUND OF THE INVENTION

1. Field of the Invention

The present invention relates to an adjustment technique for backlight source of a display device. More particularly, the present invention relates to a technique for dynamically controlling backlight source, which may control gray levels of pixels of a display panel to reduce power consumption of the backlight source.

2. Description of Related Art

A display such as a liquid crystal display (LCD) using a passive light source generally requires a backlight module to function as the light source. FIG. 1 is a schematic diagram illustrating a display mechanism of a conventional LCD. Referring to FIG. 1, a conventional LCD includes a display panel 102 comprising a pixel array for displaying an image. Each pixel of the pixel array has three primary colors of red, green and blue. For example, the pixel is composed of three sub-pixels with the three primary colors of red, green and blue, and a transmissive control unit Tcon 104 is used for controlling transmissivities of the three sub-pixels with red, green and blue colors according to a required gray level of the image.

Since the LCD panel 102 is not luminous itself, a backlight module 100 is required for providing a white light beam. The white light beam passing through the three sub-pixels with red, green and blue colors forms the light beams with the three primary colors according to the transmissivities of the sub-pixels, and then the light beams are combined to form a light beam with a desired color, and the light beam with the desired color is then provided to a human eye 106 for observation.

According to a conventional display method, the backlight module 100 provides the white light beam with a fixed intensity, and the luminances of the pixels vary by changing gray levels of the pixels, so as to achieve a variation of displaying color. In this case, light emitted from the backlight module 100 maintains a highest luminance, and a duty cycle of the backlight module 100 is 100%. Therefore, power consumption of the conventional method is relatively great, and should be reduced to save power. More particularly, a mobile device using a battery particularly requires the energy saving effect for prolonging a working time of the device.

SUMMARY OF THE INVENTION

One objective of the present invention is to provide an apparatus and a method for dynamically controlling a backlight source, where a duty cycle of a backlight module may be dynamically adjusted, so as to achieve an energy saving effect.

The present invention provides an apparatus for dynamically controlling a backlight source. The apparatus is used for receiving a pixel input data, and outputting a pixel output data and a pulse width modulation (PWM) signal. The apparatus includes an image analysis unit for receiving the pixel input data and outputting an image data after performing an image analysis. An information unit stores a relation data including a luminance adjusting data and a PWM adjusting data corresponding to a gray level range. A luminance calculation unit receives the image data from the image analysis unit and the relation data from the information unit, and also calculates a required gray level corresponding to a required luminance, and outputs a required pixel luminance data and a required PWM data according to the required gray level. A PWM adjusting unit receives the required PWM data and outputs the PWM signal. A multiplication unit receives the pixel input data and performs luminance adjustment according to the required pixel luminance data for outputting the pixel output data.

According to an embodiment of the present invention, in the aforementioned backlight source apparatus, the relation data stored in the information unit is a color luminance table and a power modulation table.

According to an embodiment of the present invention, in the aforementioned backlight source apparatus, the relation data of the information unit is a single general table, which may respectively store the luminance adjusting data and the PWM adjusting data according to a low range and a high range divided within the gray level range.

According to an embodiment of the present invention, in the aforementioned backlight source apparatus, the low range corresponds to relatively low gray levels.

According to an embodiment of the present invention, in the aforementioned backlight source apparatus, the low range within the gray level range corresponds to relatively low gray levels, and is determined according to a PWM minimum value.

According to an embodiment of the present invention, in the aforementioned backlight source apparatus, each PWM value of the low range is fixed to the PWM minimum value, and luminance of the input data may be varied according to the luminance adjusting data.

According to an embodiment of the present invention, in the aforementioned backlight source apparatus, the highest luminance of the high range is a maximum gray level, and luminance may be varied by adjusting the PWM value.

According to an embodiment of the present invention, in the aforementioned backlight source apparatus, after the luminance calculation unit calculates the required gray level, the required pixel luminance data and the required PWM data are respectively output to the multiplication unit and the PWM adjusting unit according to the low range and the high range.

According to an embodiment of the present invention, the aforementioned backlight source apparatus further includes a divider connected between the luminance calculation unit and the multiplication unit for obtaining a multiplier value for the multiplication unit.

The present invention provides an apparatus for dynamically controlling the backlight source, the apparatus is used for receiving a pixel input data, and outputting a pixel output data and a PWM signal. The apparatus includes an image analysis unit for receiving the pixel input data and outputting an image data after performing an image analysis. An information storage unit stores a luminance adjusting data and a PWM adjusting data, wherein a gray level range corresponding to the pixel input data includes a low gray level range and a high gray level range. The luminance adjusting data corresponding to the high gray level range is a fixed maximum value, and the PWM adjusting data corresponding to the low gray level range is a fixed minimum value. A table look-up unit looks up the luminance adjusting data and the PWM adjusting data to obtain a required pixel luminance data and a required PWM data. A PWM adjusting unit receives the required PWM data and outputs the PWM signal. A multiplication unit receives the pixel input data and performs luminance adjustment according to the required pixel luminance data for outputting the pixel output data.

The present invention provides a method for dynamically controlling the backlight source, by which a pixel input data is received and a pixel output data and a PWM signal are output. The method is as follows. An image analysis unit is provided for receiving the pixel input data and outputting an image data after performing an image analysis. A relation data is stored in an information unit, wherein the relation data is a luminance adjusting data and a PWM adjusting data corresponding to a gray level range. A luminance calculation is performed according to the image data and the relation data to obtain a required gray level corresponding to a required luminance. A required pixel luminance data and a required PWM data are respectively obtained according to the required gray level. A PWM adjusting unit is provided for receiving the required PWM data and correspondingly outputting the PWM signal. A multiplication unit is provided for receiving the pixel input data and performing luminance adjustment according to the required pixel luminance data, so as to output the pixel output data.

In order to make the aforementioned and other objects, features and advantages of the present invention comprehensible, a preferred embodiment accompanied with figures is described in detail below.

DESCRIPTION OF EMBODIMENTS

A luminance equation is provided by the present invention by analysing a generation mechanism of a luminance required for displaying an image. The equation is:

$$L=b*t, \tag{1}$$

wherein L represents a required luminance, b represents an intensity of a light source provided by a backlight module, and t represents a required gray level corresponding to a pixel transmissivity (i.e. pixel data). As mentioned above, in a conventional mechanism, b is a fixed value, which is a total luminance when the backlight module fully turns on, and may maintain a same status during a display cycle. In other words, the backlight module may maintain a 100% duty cycle without variation. However, this may cause a relatively high power consumption of the backlight module.

By analysing the problems of the conventional techniques in detail, a method of dynamically adjusting the above-mentioned value b of the backlight module is provided, namely, the duty cycle of the backlight module may be dynamically adjusted, wherein the duty cycle corresponds to the parameter b. However, since an actual required luminance of the pixel has to be maintained for generating the desired color, an original gray level of the pixel should be changed to a required gray level (i.e. the corresponding parameter t) accordingly for matching the duty cycle of the backlight module, so as to achieve an actual required luminance L. Embodiments of the present invention will now be described in detail below, however, the present invention is not limited to the embodiments set forth herein. The presented embodiments may also be properly combined to one other, which is not limited to an individual embodiment.

Figure 1:
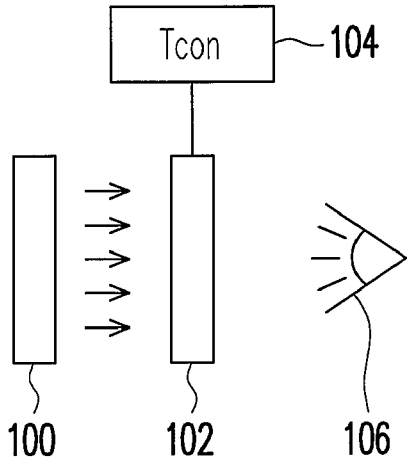
FIG. 1 (PRIOR ART)
FIG. 1 is a schematic diagram illustrating a display mechanism of a conventional LCD.
Figure 2:
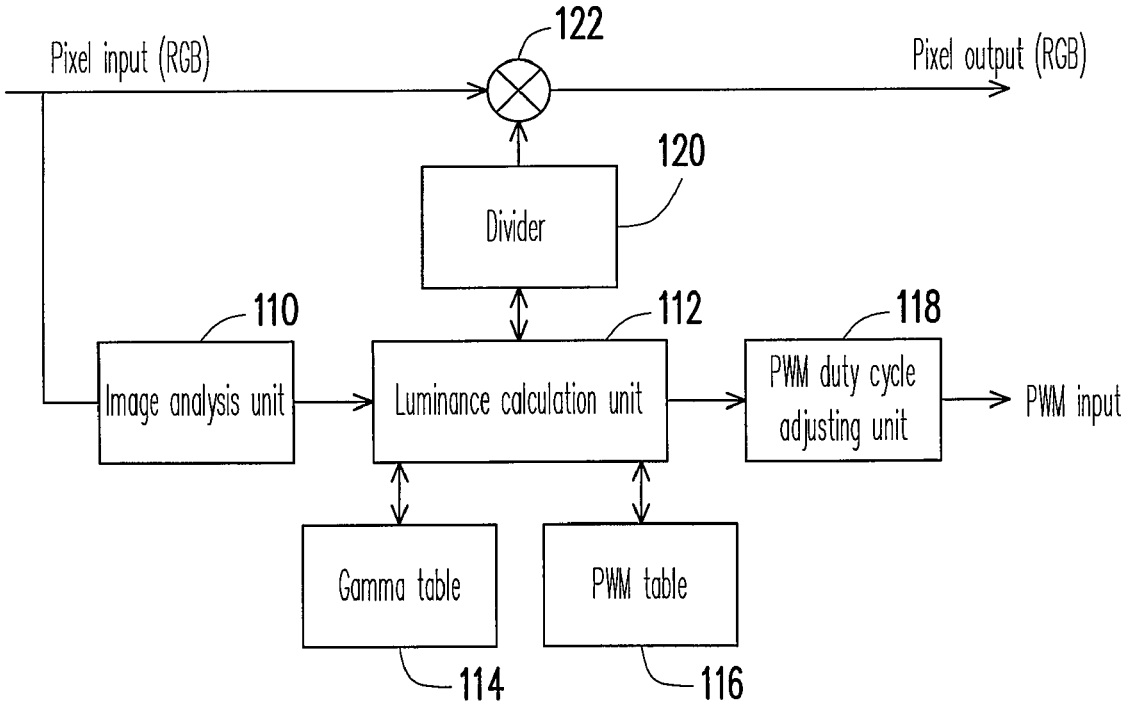
FIG. 2 is a block diagram illustrating a circuit of an apparatus for dynamically controlling a backlight source according to an embodiment of the present invention.

FIG. 2 is a block diagram illustrating a circuit of an apparatus for dynamically controlling a backlight source according to an embodiment of the present invention. Referring to FIG. 2, the apparatus for dynamically controlling the backlight source receives a RGB pixel input data, and outputs a pixel output data and a PWM signal after analysing and processing. The apparatus includes an image analysis unit 110 for receiving the pixel input data and outputting an image data after performing an image analysis. An information unit stores a relation data including a luminance adjusting data 114 and a PWM adjusting data 116 corresponding to a gray level range. The gray level range may be a range from the black to the white. The luminance adjusting data 114 may be a gamma table 114 used for luminance adjusting. The PWM adjusting data 116 may be a PWM table 116 used for controlling the duty cycle of the backlight module. A relationship between the gamma table 114 and the PWM table 116 will be described below.

Next, a luminance calculation unit 112 receives the image data from the image analysis unit 110, the luminance adjusting data 114 and the PWM adjusting data 116, calculates a required gray level corresponding to a required luminance according to the equation (1), and then respectively outputs a required pixel luminance data and a required PWM data according to the required gray level, the gamma table 114 and the PWM table 116. A PWM duty cycle adjusting unit 118 receives the required PWM data and outputs the PWM signal for adjusting the PWM duty cycle of the backlight module. A multiplication unit 122 receives the pixel input data and multiply the pixel input data with a luminance adjusting multiplier for outputting the pixel output data, wherein the luminance adjusting multiplier corresponds to the required pixel luminance data and is obtained by looking up the gamma table 114. By such means, a required luminance may be achieved according to a combination of the pixel output data and the adjusted PWM duty cycle. Moreover, to cooperate an operation of the multiplication unit 122, a divider 120 may be provided in the present embodiment, which is used for modifying the luminance adjusting multiplier.

Figure 3:
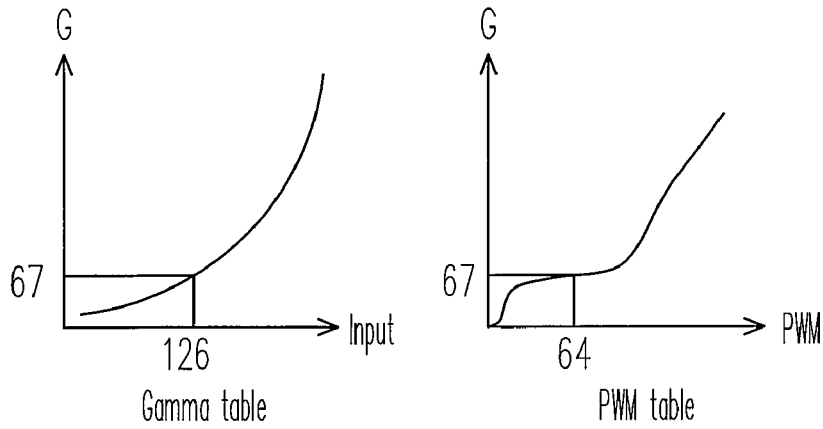
FIG. 3 is a diagram of the gamma table 114 and the PWM table 116 according to an embodiment of the present invention.

FIG. 3 is a diagram of the gamma table 114 and the PWM table 116 according to an embodiment of the present invention. Referring to FIG. 3, the gamma table 114 is a gamma curve formed by the pixel input data and luminance values (G), which is used for modifying the luminance. The PWM table 116 is a relation curve formed by the luminance values (G) and the PWM values. As described above, the luminance calculation unit 112 may calculate the required pixel output data and the required PWM duty cycle according to the gamma table 114 and the PWM table 116. However, in case of the embodiment of FIG. 2, the relation data thereof is stored in forms of the two data tables, and therefore a relatively greater memory volume is required for storing the required data of FIG. 3.

Several principles are provided by the present invention for simplifying a relation table established for substituting the original PWM table and the gamma table. First, it should be noted that the output pixel data value is the input pixel data value multiply a multiplier value (k), k=output data/input data. Moreover, L(total luminance)=b(luminance value of the PWM maximum value)*t(luminance value of the input pixel data)=b(modified PWM luminance value)*t(luminance value of the output pixel data). According to the equations, in the conventional mechanism, b in the former equation is set to the PWM maximum value. To save the power, in the present invention, t (output pixel data) may be adjusted to correspondingly adjust b (the output PWM), such that the duty cycle of the backlight module may be decreased and power consumption is reduced.

Assuming the range of the PWM is from 0 to 255, and assuming a PWM minimum value is set to 64, and a PWM maximum value is 255. Moreover, the corresponding range of the input gray levels from the black to the white is also from 0 to 255. It should be noted that the PWM maximum value 255 and the PWM minimum value 64 are only for the purpose of description and is not intended to be limiting of the invention. Namely, in a practical application, the required maximum value and the minimum value may be determined according to different demands.

According to the PWM table of FIG. 3, the luminance value corresponding to the PWM minimum value 64 is 67. Next, according to the gamma table, the pixel input value corresponding to the luminance value 67 is 126, which is regarded as a division value. Namely, in the present embodiment, if the pixel input value is less than 126, the corresponding PWM value is then set to the minimum value 64, so as to adjust an output data to achieve the required luminance. By such means, since the PWM value is maintained to the minimum value 64, an optimal energy saving effect then may be achieved. In case of the pixel input value being greater than 126, since a present required luminance is relatively great, and if the PWM value is still maintained to the minimum value, the required luminance cannot be achieved. Therefore, in this case, the output data is set to the maximum value 255, so as to achieve the optimal energy saving effect.

As described above, to achieve the optimal energy saving effect, the pixel input data range is divided into two ranges including a low range and high range, and based on the aforementioned method, all the corresponding relations of the data may be listed within a look-up table. Referring to table 1, the corresponding relations of the pixel input data, the PWM value, the multiplier value (k), and the pixel output data are listed therein.

According to the aforementioned method, the output PWM value includes the PWM minimum value 64 and the PWM maximum value 255, and the gray level 126 of the pixel input data is regarded as the division value. Therefore, the gray level range may be divided into a low range and high range.

In case of the low range, when the pixel input data is less than or equal to 126, the output PWM value is then set to the PWM minimum value 64.

According to the aforementioned equation: L (total luminance)=b (luminance value of the PWM maximum value)*t (luminance value of the input pixel data)=b (modified PWM luminance value)*t(luminance value of the output pixel data). Therefore, in case of the low range, the equation becomes: L=b(255)*t(input)=b(64)*t(output). Therefore, the required output pixel data corresponding to the input pixel data then may be calculated according to the above equation. Moreover, since the multiplier value (k)=output data/input data, the multiplier value then also may be easily obtained by calculation.

It should be noted that in case of the relatively small input data, which may be within a range of 0~16, since the output may be in a saturated state, the output data then may be directly set to 32 according to the present invention. The other corresponding output data may also be obtained by calculation according to the above equation, and are listed in the look-up table 1.

For example, if the input data is 18, according to the above equation, L=b(255)*t(18)=b(64)*t(output), and then t(output)=b(255)*t(18)/b(64) may be deduced. Next, the data to be output may be deduced according to the gamma table: output=$t^{-1}$[b(255)*t(18)/b(64)]=45, and then the multiplier value may be obtained as: multiplier value (k)=45/18=2.5.

TABLE 1

| Input data | PWM value | Multiplier value (k) | Output data |
|---|---|---|---|
| 0 | 64 | 32 | 32 |
| 1 | 64 | 16.1 | 32 |
| 2 | 64 | 10.5 | 32 |
| 3 | 64 | 8 | 32 |
| . | . | . | . |
| . | . | . | . |
| . | . | . | . |
| 16 | 64 | 2 | 32 |
| 17 | 64 | 2.64 | 45 |
| 18 | 64 | 2.5 | 45 |
| . | . | . | . |
| . | . | . | . |
| . | . | . | . |
| 125 | 64 | 1.99 | 249 |
| 126 | 64 | 2.02 | 255 |
| 127 | 65 | 2 | 255 |
| 128 | 66 | 1.99 | 255 |
| . | . | . | . |
| . | . | . | . |
| . | . | . | . |
| 252 | 249 | 1.02 | 255 |
| 253 | 251 | 1.02 | 255 |
| 254 | 253 | 1.01 | 255 |
| 255 | 255 | 1.01 | 255 |

In case of the pixel input value is within the high range, i.e. within a range above 126, as described above, to achieve the optimal energy saving effect, the pixel output value may be set to a maximum transmissivity 255. Therefore, for example, if the pixel input value is 127, the multiplier value (k) then may be obtained according to the equation: multiplier value (k)=255 (pixel output value)/127 (pixel input value)=2.0, and special establishment of the output PWM value table is unnecessary. However, when the pixel output value is set to the maximum value 255, the output PWM value may be relatively decreased, so as to maintain a predetermined luminance, and therefore the output PWM value table is required to be established.

For example, if the input pixel data is 252, according to the equation: L=b(255)*t(252)=b(PWM output)*t(255), since b(255), t(252), t(255) are known, b(PWM output) may be deduced accordingly, and the required PWM output value is 249.

As described above, the look-up table 1 is established, and calculation of the data corresponding to other input data may be performed by those skilled in the art, and the detailed description thereof will not be repeated.

It should be noted that in the embodiment of FIG. 2, the luminance calculation unit 112 may real-time calculate the required pixel output data and the PWM output value (i.e. the PWM value, the multiplier value (k) and the output data listed in the table 1 may be real-time calculated) according to the input data, the PWM table 116 and the gamma table 114. However, in another embodiment of the present invention, the data in table 1 may also be stored in advance, such that real-time calculation according to the input data is unnecessary, and the required PWM value, the multiplier value (k) and the output data may be directly read from the look-up table 1.

Figure 4:
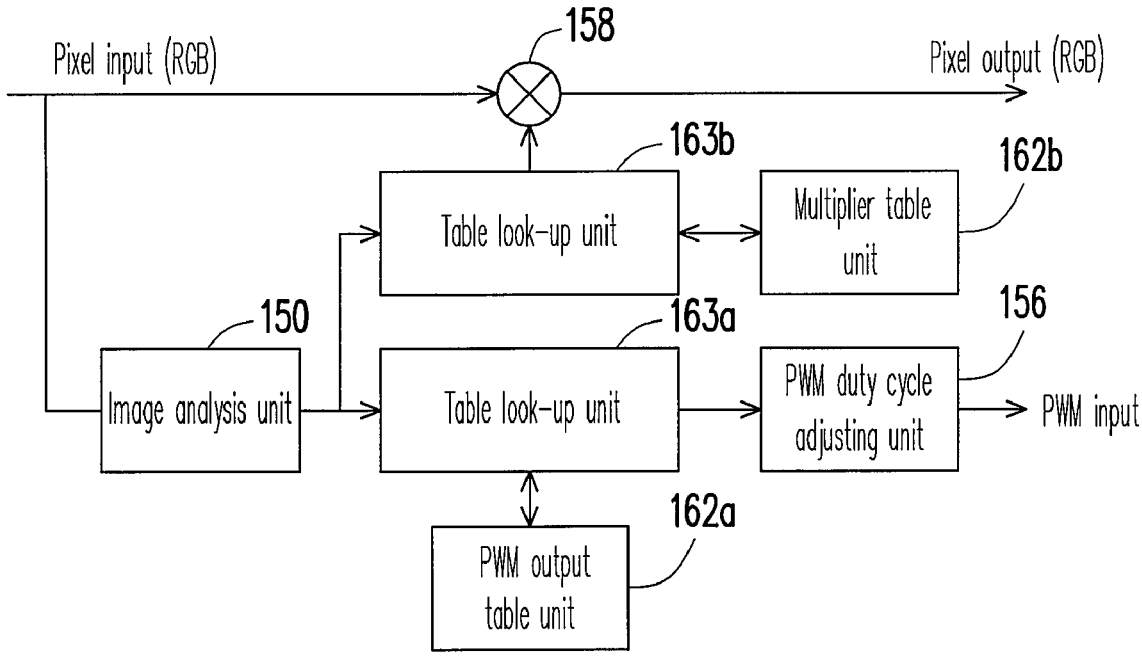
FIG. 4 is a block diagram illustrating a circuit of an apparatus for dynamically controlling a backlight source according to another embodiment of the present invention.

FIG. 4 is a block diagram illustrating a circuit of an apparatus for dynamically controlling a backlight source according to another embodiment of the present invention. Referring to FIG. 4, in the present embodiment, the apparatus for dynamically controlling the backlight source may simultaneously use two tables. The PWM output table unit 162*a* includes two fields for the input data and the PWM values of table 1; a multiplier table unit 162*b* includes two fields for the input data and the multiplier values (k). Therefore, an image analysis unit 150 may directly output analysed data to two table look-up units 163*a* and 163*b* for correspondingly looking up the PWM output table unit 162*a* and the multiplier table unit 162*b*, so as to correspondingly output a required PWM value to a PWM duty cycle adjusting circuit 156, and a required multiplier value to a multiplication unit 158. Moreover, the two table look-up units 163*a* and 163*b* may also be integrated as one table look-up unit according to an actual requirement for looking up the required data from the PWM output table unit 162*a* and the multiplier table unit 162*b*.

In addition, table 1 may be further simplified according to the present invention. It should be noted that since two pixel input ranges are divided according to display characteristics. For example, the PWM output values within the low range are all the minimum values 64, these values are not necessary to store. The multiplier values (k) within the high range are all values obtained according to a fixed rule, and therefore these values are not necessary to store, either. Thus, to further save the memory volume, the table 1 may be simplified as a combined table, shown as follows.

TABLE 2

| Input data | Multiplier value and PWM value |
|---|---|
| 0 | 32 |
| 1 | 16.1 |
| 2 | 10.5 |
| 3 | 8 |
| . | . |
| . | . |
| . | . |
| 16 | 2 |
| 17 | 2.64 |
| 18 | 2.5 |
| . | . |
| . | . |
| . | . |
| 125 | 1.99 |
| 126 | 2.02 |
| 127 | 65 |
| 128 | 66 |
| . | . |
| . | . |
| . | . |
| 252 | 249 |
| 253 | 251 |
| 254 | 253 |
| 255 | 255 |

According to table 2, only values corresponding to 255 data are needed to be stored within the combined table. It can be seen that when the input data is within the low range, for example within 0~126, the stored data are the multiplier values (k), and when the input data is within the high range, for example within 127~255, the stored data are the PWM output values. Therefore, the memory space used for storing the data of table 2 may be effectively reduced.

Figure 5:
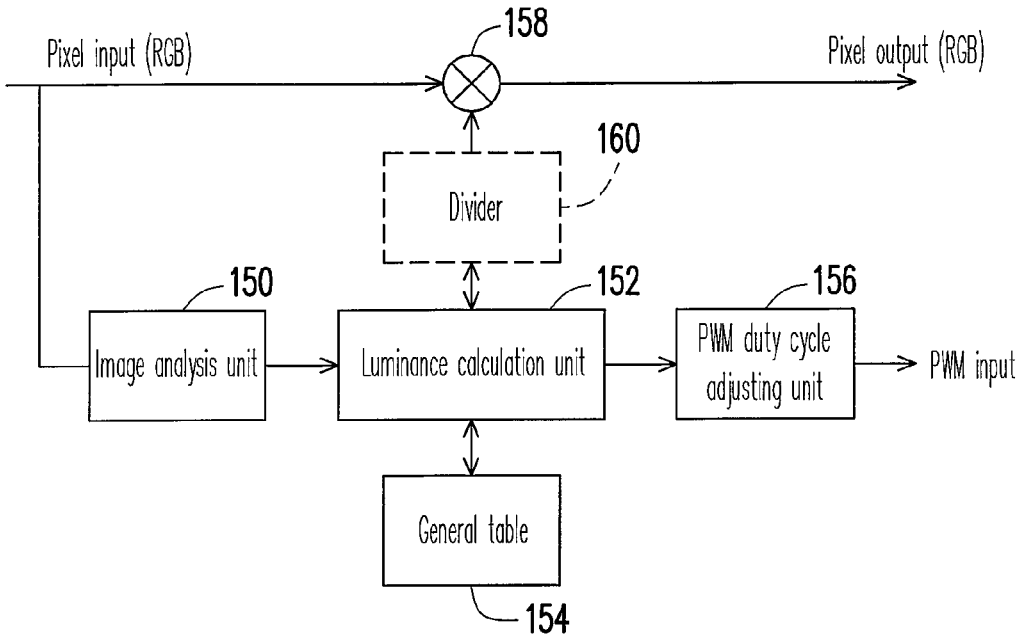
FIG. 5 is a block diagram illustrating a circuit of an apparatus for dynamically controlling a backlight source according still another embodiment of the present invention.

In coordination with the features of the table 2, the embodiments of FIG. 2 and FIG. 4 may also be simplified. FIG. 5 is a block diagram illustrating a circuit of an apparatus for dynamically controlling a backlight source according still another embodiment of the present invention. Referring to FIG. 5, compared to the circuit of FIG. 2, the combined table 154 of the present embodiment established according to the data of the table 2 includes the multiplier values and the PWM values. The luminance calculation unit 152 outputs the corresponding data to the PWM duty cycle adjusting circuit 156 according to a look-up result of the combined table 154, so as to output an adjusted PWM output, or the luminance calculation unit 152 outputs the multiplier value to the multiplication unit 158 according to the look-up result of the combined table 154, so as to output an adjusted pixel output. The divider 160 may be used for cooperating the calculation of the luminance calculation unit 152 according to the combined table 154. In another embodiment of the present invention, the divider 160 may be omitted. Moreover, an image analysis unit 150 of FIG. 5 is the same as the image analysis unit 110 of FIG. 2. Therefore, the circuit structure of FIG. 5 may further simplify an establishment of the relation data table, and reduce a requirement of the memory volume.

Furthermore, the circuit structure of FIG. 5 may be further simplified to a table look-up circuit. Namely, the only requirement for the luminance calculation unit 152 is that it may look up the required data corresponding to the input pixel from the general table 154, and may respectively transmit the required data to the PWM duty cycle adjusting circuit 156 and the divider 160. By such means, in case of the high range, the divider 160 calculates the multiplier value for the multiplication unit 158 according to the fixed rule, such that the adjusted pixel transmissivity may be maintained to the maximum value, which belongs to the high range of table 2. Since the pixel transmissivity is maintained to the maximum value, luminance variation may be implemented by dynamically adjusting the PWM value.

Figure 6:
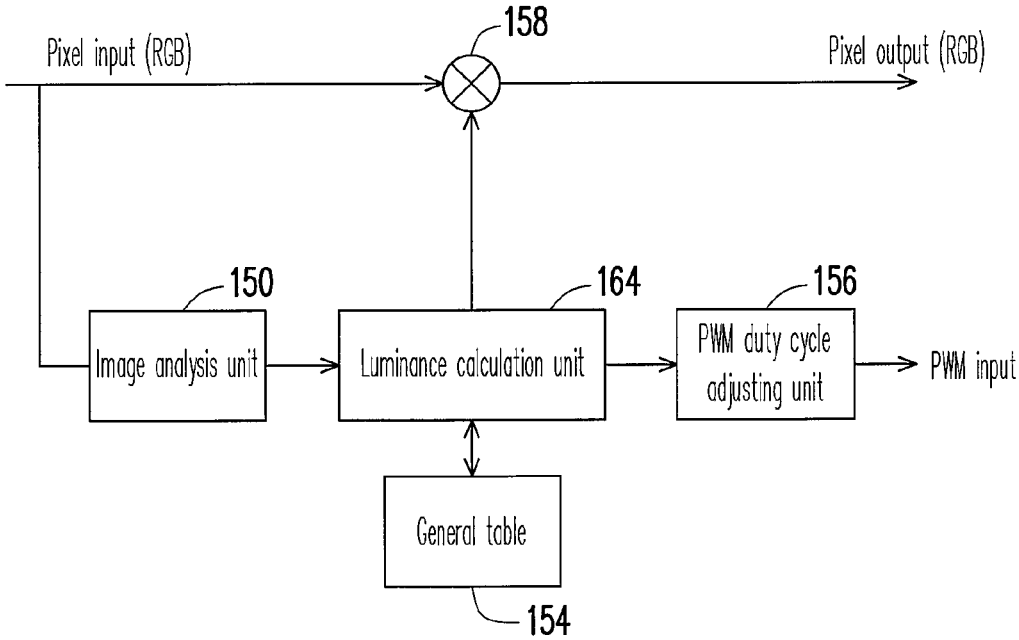
FIG. 6 is a block diagram illustrating a circuit of an apparatus for dynamically controlling a backlight source according yet another embodiment of the present invention.

According to the signal general table, FIG. 6 is a block diagram illustrating an apparatus for dynamically controlling a backlight source according to an embodiment of the present invention. Referring to FIG. 6, after the luminance calculation unit 164 receives data from the image analysis unit 150, data to be output to the PWM duty cycle adjusting circuit 156 or multiplication unit 158 then may be obtained. Circuit of the luminance calculation unit 164 may be designed according to an actual requirement and a design of the general table 154, which is not limited to a specific circuit, and meanwhile the divider may also be omitted. In other words, under a same operation mechanism, circuit design and pre-storage of the values of the general table 154 may all be varied according to the actual requirement, and the detailed description thereof will not be repeated.

In summary, with a same required luminance, the gray level of the original pixel data may be increased, such that the intensity of backlight source is allowed to be reduced, and reduction of the intensity of backlight source may be implemented by adjusting the duty cycle of the backlight module. Moreover, the relation table may also be simplified as the single general table, so as to save the memory volume.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An apparatus for dynamically controlling backlight source, for receiving a pixel input data to output a pixel output data and a pulse width modulation (PWM) signal, the apparatus comprising:

an image analysis unit, for receiving the pixel input data, and performing an image analysis to output an image data;

an information unit, for storing a relation data including a luminance adjusting data and a PWM adjusting data corresponding to a gray level range, wherein the gray level range is just divided into two ranges of a low range and a high range;

a luminance calculation unit, for receiving the image data from the image analysis unit and the relation data from the information unit, configured to calculate a required gray level corresponding to a required luminance, and respectively output a required pixel luminance data and a required PWM data according to the required gray level, wherein the required PWM data is constantly adjusted to a PWM minimum value and the required gray level is non-constantly adjusted when a gray level of the pixel input data is at the low range, wherein the required PWM data is non-constantly adjusted and the required gray level is constantly adjusted to a maximum value when the gray level of the pixel input data is at the high range;

a PWM adjusting unit, for receiving the required PWM data to output the PWM signal; and a multiplication unit, for receiving the pixel input data and performing a luminance adjustment to the pixel input data according to the required pixel luminance data to output the pixel output data.

2. The apparatus for dynamically controlling backlight source as claimed in claim 1, wherein the relation data stored in the information unit comprise a color luminance table and a power modulation table.

3. The apparatus for dynamically controlling backlight source as claimed in claim 1, wherein the relation data stored in the information unit is a combined table storing the luminance adjusting data in the low range and the PWM adjusting data in the high range.

4. The apparatus for dynamically controlling backlight source as claimed in claim 3, wherein the low range within the gray level range corresponds to relatively low gray levels.

5. The apparatus for dynamically controlling backlight source as claimed in claim 3, wherein the low range within the gray level range corresponds to relatively low gray levels, and is determined according to the PWM minimum value.

6. The apparatus for dynamically controlling backlight source as claimed in claim 3, wherein each of the PWM value of the low range is the PWM minimum value, and luminance is varied according to the luminance adjusting data.

7. The apparatus for dynamically controlling backlight source as claimed in claim 3, wherein each of the pixel output data of the high range is a maximum gray level, and luminance is varied according to the PWM adjusting data.

8. The apparatus for dynamically controlling backlight source as claimed in claim 3, wherein after the luminance calculation unit calculates the required gray level, the required pixel luminance data and the required PWM data are respectively output to the multiplication unit and the PWM adjusting unit according to the low range and the high range.

9. The apparatus for dynamically controlling backlight source as claimed in claim 1 further comprising a divider connected between the luminance calculation unit and the multiplication unit for obtaining a multiplier value for the multiplication unit.

10. An apparatus for dynamically controlling backlight source, for receiving a pixel input data to output a pixel output data and a PWM signal, the apparatus comprising:

an image analysis unit, for receiving the pixel input data, and performing an image analysis to output an image data;

an information unit, for storing a luminance adjusting data and a PWM adjusting data, wherein a gray level range corresponding to the pixel input data is just divided into two ranges of a low gray level range and a high gray level range, the luminance adjusting data corresponding to the high gray level range is a fixed maximum value while the PWM adjusting data is non-constantly adjusted, and the PWM adjusting data corresponding to the low gray level range is a fixed minimum value while the luminance adjusting data is non-constantly adjusted;

a table look-up unit, for looking up the luminance adjusting data and the PWM adjusting data to obtain a required pixel luminance data and a required PWM data;

a PWM adjusting unit, for receiving the required PWM data to output the PWM signal; and a multiplication unit, for receiving the pixel input data and performing a luminance adjustment according to the required pixel luminance data to output the pixel output data.

11. The apparatus for dynamically controlling backlight source as claimed in claim 10, wherein the low gray level range within the gray level range corresponds to relatively low gray levels.

12. The apparatus for dynamically controlling backlight source as claimed in claim 10, wherein the low gray level range within the gray level range corresponds to relatively low gray levels, and is determined according to a PWM minimum value.

13. The apparatus for dynamically controlling backlight source as claimed in claim 10, wherein each of the PWM value of the low gray level range is the PWM minimum value, and luminance is varied according to the luminance adjusting data.

14. The apparatus for dynamically controlling backlight source as claimed in claim 10, wherein each of the pixel output data of the high gray level range is a maximum gray level, and luminance is varied according to the PWM adjusting data.

15. A method for dynamically controlling backlight source, for receiving a pixel input data to output a pixel output data and a PWM signal, the method comprising:

providing an image analysis unit, for receiving the pixel input data, and performing an image analysis to output an image data;

storing a relation data in an information unit, wherein the relation data comprises a luminance adjusting data and a PWM adjusting data corresponding to a gray level range wherein the gray level range is just divided into two ranges of a low range and a high range;

performing a luminance calculation according to the image data and the relation data to obtain a required gray level corresponding to a required luminance;

respectively obtaining a required pixel luminance data and a required PWM data according to the required gray level, wherein the required PWM data is constantly adjusted to a PWM minimum value and the required gray level is non-constantly adjusted when a gray level of the pixel input data is at the low range, wherein the required PWM data is non-constantly adjusted and the required gray level is constantly adjusted to a maximum gray level when the gray level of the pixel input data is at the high range;

providing a PWM adjusting unit, for receiving the required PWM data to output the PWM signal; and providing a multiplication unit, for receiving the pixel input data and performing a luminance adjustment according to the required pixel luminance data to output the pixel output data.

16. The method for dynamically controlling backlight source as claimed in claim 15, wherein the relation data stored in the information unit is a single general table, which respectively stores the luminance adjusting data and the PWM adjusting data according to the low range and the high range.

17. The method for dynamically controlling backlight source as claimed in claim 15, wherein the low range is about a half of the gray level range, and corresponds to relatively low gray levels.

18. The method for dynamically controlling backlight source as claimed in claim 15, wherein the low range within the gray level range corresponds to relatively low gray levels, and is determined according to the PWM minimum value.

19. The method for dynamically controlling backlight source as claimed in claim 15, wherein each of the PWM value of the low range is the PWM minimum value, and luminance is varied according to the luminance adjusting data.

20. The method for dynamically controlling backlight source as claimed in claim 15, wherein each of the pixel output data of the high range is the maximum gray level, and luminance is varied according to the PWM adjusting data.

21. The method for dynamically controlling backlight source as claimed in claim 15, wherein after the step of respectively obtaining the required pixel luminance data or the required PWM data according to the required gray level, the required pixel luminance data is output to the multiplication unit, and the required PWM data is output to the PWM adjusting unit.

* * * * *